US005122841A

United States Patent [19]

Sasaki

[11] Patent Number: 5,122,841

[45] Date of Patent: Jun. 16, 1992

[54] IMAGE FORMING APPARATUS

[75] Inventor: Nobukazu Sasaki, Yokohama, Japan

[73] Assignee: Canon Kabushiki Kaisha, Tokyo, Japan

[21] Appl. No.: 758,514

[22] Filed: Sep. 6, 1991

Related U.S. Application Data

[63] Continuation of Ser. No. 394,541, Aug. 16, 1989, abandoned.

[30] Foreign Application Priority Data

Aug. 18, 1988 [JP] Japan ..... 63-205008

[51] Int. Cl.[5] ..... G03G 21/00

[52] U.S. Cl. ..... 355/321; 355/308; 355/205; 271/117

[58] Field of Search ..... 355/308, 309, 314, 321, 355/204, 205, 206, 208; 271/117, 118, 263

[56] References Cited

U.S. PATENT DOCUMENTS 4,116,556 9/1978 Tanaka et al. ..... 355/309 X
4,412,734 11/1983 Shibuya et al. ..... 355/309
4,526,464 7/1985 Milillo ..... 355/309
4,583,844 4/1986 Honda ..... 355/309
4,609,276 9/1986 Mitzutani ..... 355/309 X
4,804,998 2/1989 Miyawaki ..... 355/206
4,872,660 10/1989 Kameyama et al. ..... 271/117 X
4,878,087 10/1989 Sakai et al. ..... 355/207

FOREIGN PATENT DOCUMENTS 0322818 7/1989 European Pat. Off. ..... 355/309
0089756 7/1981 Japan ..... 355/309
0179877 10/1983 Japan ..... 355/309

*Primary Examiner*—A. T. Grimley
*Assistant Examiner*—Matthew S. Smith
*Attorney, Agent, or Firm*—Fitzpatrick, Cella, Harper & Scinto

[57] ABSTRACT

A sheet feeding apparatus has a sheet container for accommodating sheets, a sheet feeder for feeding the sheet by contacting the sheets in the sheet container, a guide for guiding the sheet fed by the sheet feeder and being shiftable to open a sheet feeding path, and a spacer for separating the sheet feeder from the sheet in response to the shift of the guide.

34 Claims, 10 Drawing Sheets

IMAGE FORMING APPARATUS

This application is a continuation of application Ser. No. 07/394,541 filed Aug. 16, 1989, now abandoned.

BACKGROUND OF THE INVENTION

1. Field of the Invention

The present invention relates to an image forming apparatus such as a copying machine, a laser beam printer and the like, and more particularly, it relates to an image forming apparatus (referred to as "copying machine" hereinafter) including a sheet containing device (referred to as "cassette" hereinafter) for accommodating a plurality of sheets, which cassette is removably arranged within the copying machine.

2. Related Background Art

In the past, a copying machine including a cassette (for accommodating a plurality of sheets) removably mounted within the body of the machine has already been known. In such conventional copying machine, a friction pad or a retard roller is used as a sheet separating means. Further, such copying machine is designed so that a jammed sheet can be removed by retracting it toward a sheet feeding direction (refer to FIG. 8A).

However, in such conventional copying machine, there arises a problem that, when the jammed sheet is pulled toward the sheet feeding direction to remove it, a next sheet adjacent to the undersurface of the jammed sheet is often shifted together with the pulled sheet to abut against the sheet separating means, thus bending the next sheet (refer to FIG. 8B). In order to solve such problem, a copying machine wherein when the jammed sheet is removed the sheet separating means is retarded or retracted from the sheet feeding path has been proposed.

In such copying machine, there is an advantage that when the cassette is extracted toward a direction opposite to the sheet feeding direction any sheet does not remain on the sheet separating means (refer to FIG. 8C); however, there arises a drawback that, when the jammed sheet is pulled or extracted toward the sheet feeding direction, since the friction force between the stacked sheets is increased by the pressing action of the sheet feed roller, sheets positioned below the jammed sheet are successively shifted in response to the pulling action of the jammed sheet (refer to FIG. 8D).

SUMMARY OF THE INVENTION

It is an object of the present invention to provide an image forming apparatus which can eliminate the above-mentioned conventional drawbacks and wherein the jammed sheet can easily be removed.

Another object of the present invention is to provide an image forming apparatus which can eliminate the above-mentioned conventional drawbacks by separating a sheet feed rotary member from a sheet.

Explaining the feature of the present invention with reference to FIGS. 1 to 3, the image forming apparatus according to the present invention, including sheet containing devices (65U, 65L) removably mounted within a body (53), for accommodating a plurality of sheets (S) therein, and a sheet feed rotary member (12) supported for an up-and-down movement, for feeding a sheet from the sheet containing devices (65U, 65L) (S), and the containing device (65U, 65L) has a characteristic that a separating means (27U, 27U*a*, 27U*c*, 27L, 27L*a*, 27L*c*) for separating the sheet feed rotary member (12) from the sheets (s) stacked in the sheet containing devices (65U, 65L) is provided.

With this arrangement, the sheets accommodated in the sheet containing device can be fed successively by means of the sheet feed rotary member. When the jammed sheet is removed, the sheet feed rotary member is separated from the sheets accommodated in the sheet containing device by means of the separating means.

DETAILED DESCRIPTION OF THE PREFERRED EMBODIMENTS

Figure 2:
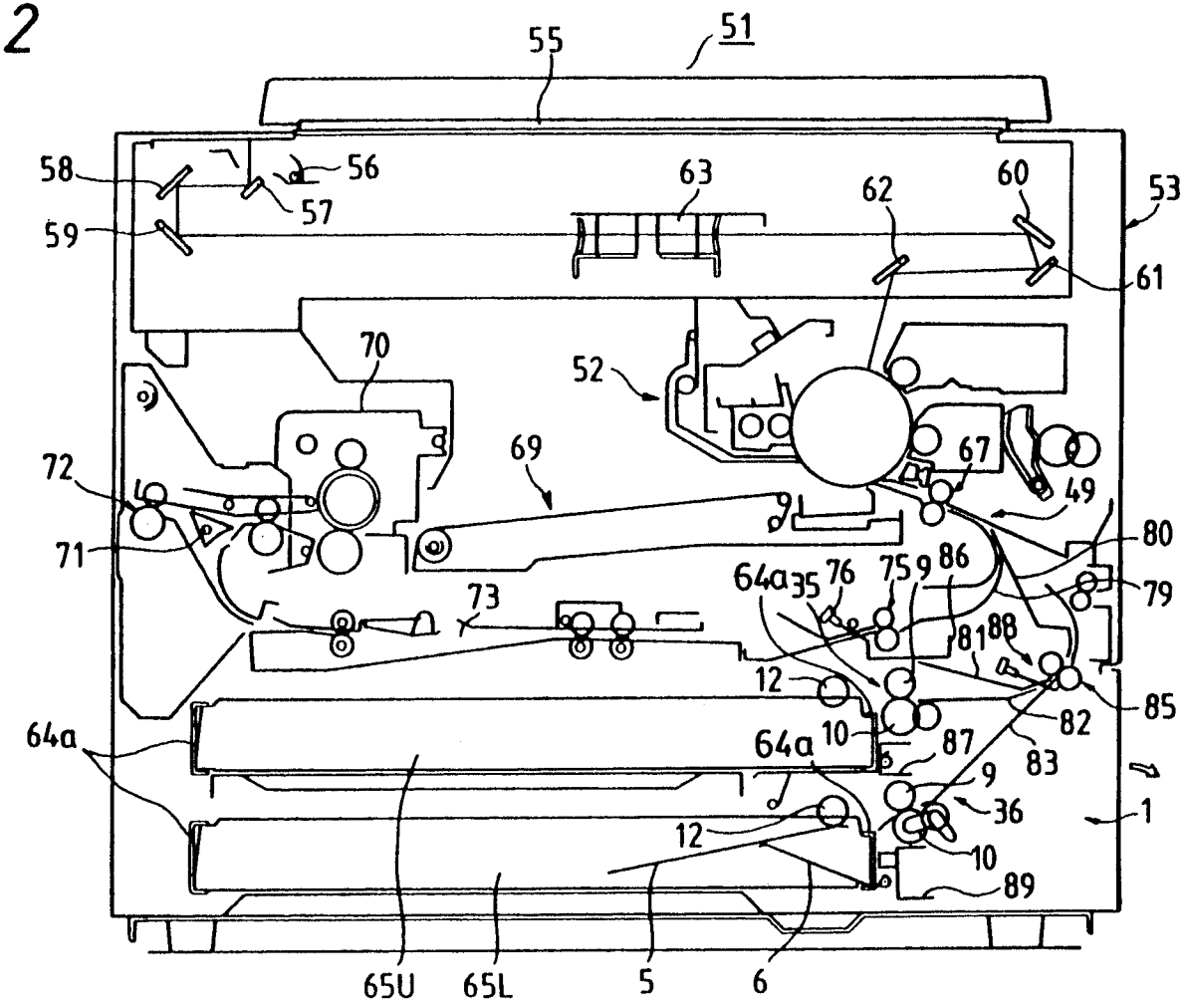
FIG. 2 is a sectional plan view of the image forming apparatus according to the present invention.

The present invention will now be explained in connection with embodiments thereof with reference to the accompanying drawings As shown in FIG. 2, a copying machine 51 includes a frame body 53 into which a copying portion 2 is incorporated. The body 53 includes therein a platen 55, a light source 56, mirrors 57, 58, 59, 60, 61, 62, a lens 63, and two cassettes 65U, 65L for accommodating sheets S therein. The cassettes can be moved along guide rails 64*a*, and thus, can be removably mounted within the body 53.

Each of the cassettes 65U, 65L has an intermediated plate 5, and can be extracted from the body 53 along the corresponding guide rail toward a direction perpendicular to a sheet feeding direction in order to replenish the sheets. A sheet feeding device 1 is arranged in the vicinity of these cassettes 65U and 65L.

A sheet feed roller 12 is associated with the cassette 65U, and a sheet separating portion 35 comprising a feeding roller 9 and a separating roller 10 is arranged downstream side of the sheet feed roller 12. On the other hand, a sheet feed roller 12 is associated with the cassette 65L, and a sheet separating portion 36 comprising a feeding roller 9 and a separating roller 10 is arranged downstream side of the sheet feed roller 12.

A pair of regist rollers 67 are arranged downstream side of the sheet feeding device 1, and the above-mentioned copying portion 52 is arranged downstream side of the regist roller pair 67, and further, a feeding belt 69 and a fixing device 70 are arranged downstream side of the copying portion 52. A flapper 71 and a pair of ejector rollers 72 are arranged downstream side of the fixing device 70, and a sheet recirculating path 73 is branched from the flapper 71. A pair of sheet recirculating rollers 75 and a sheet recirculating sensor 76 are arranged in the sheet recirculating path 73.

The guide rails 64*a* and 64*b* are attached to the frame body 53, and the sheet feeding device 1 can be positioned by abutting front and rear side plates 23, 17 (FIG. 10) against the guide rails 64*b*. Further, each guide rail 64*b* has a recess or groove (not shown) formed therein for receiving a pressure plate 6.

Figure 9:
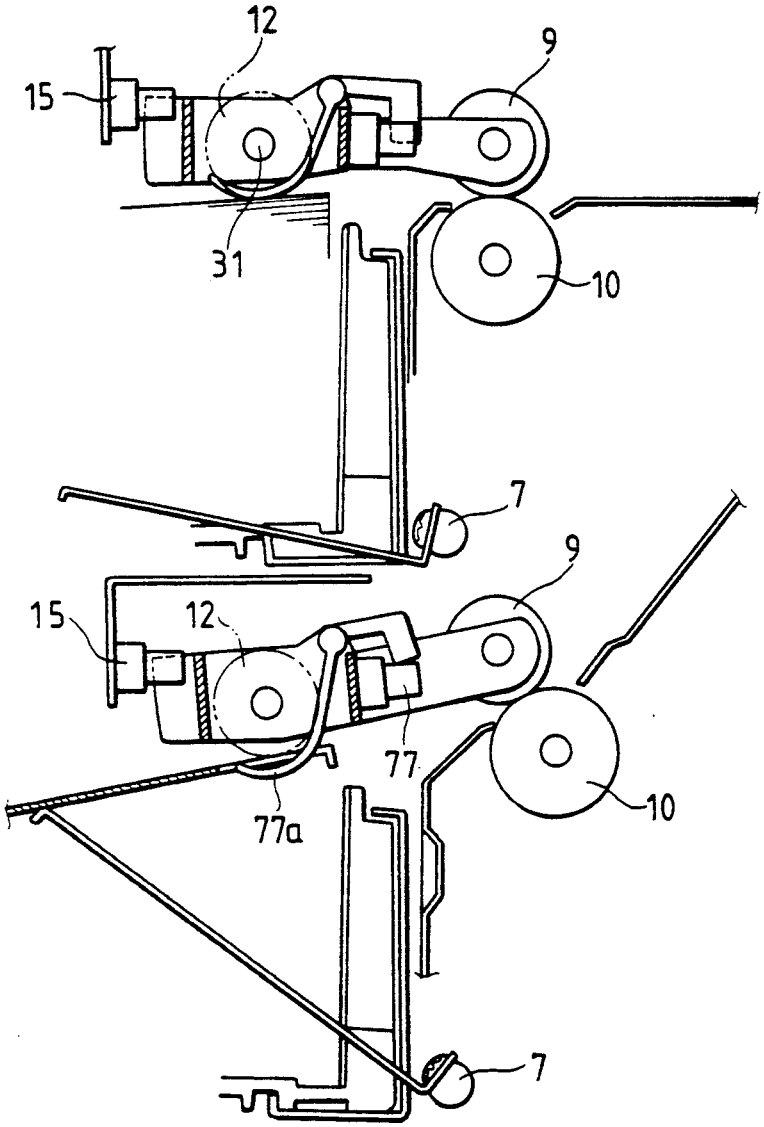
FIGS. 9 and 10 are plan views showing the details of the present invention.

The sheet feeding device 1 includes a frame comprising an upper stay 86, an intermediate stay 87 and a lower stay 89, and further includes, in associated with the frame, the above-mentioned sheet feed rollers 12, the feeding rollers 9, the separating rollers 10, sheet presence sensors 77 (FIGS. 9, 10), the pressure plates 6, positioning sensors 15, guide plates 79, 80, 81, 82, 83 and a pair of regist rollers 85, whereby the sheet feeding device 1 is constituted as an integral unit. Incidentally, the reference numerals 76 and 88 10 designate sheet sensors, and 77*a* designates an actuator for each sheet presence sensor 77.

Figure 1:
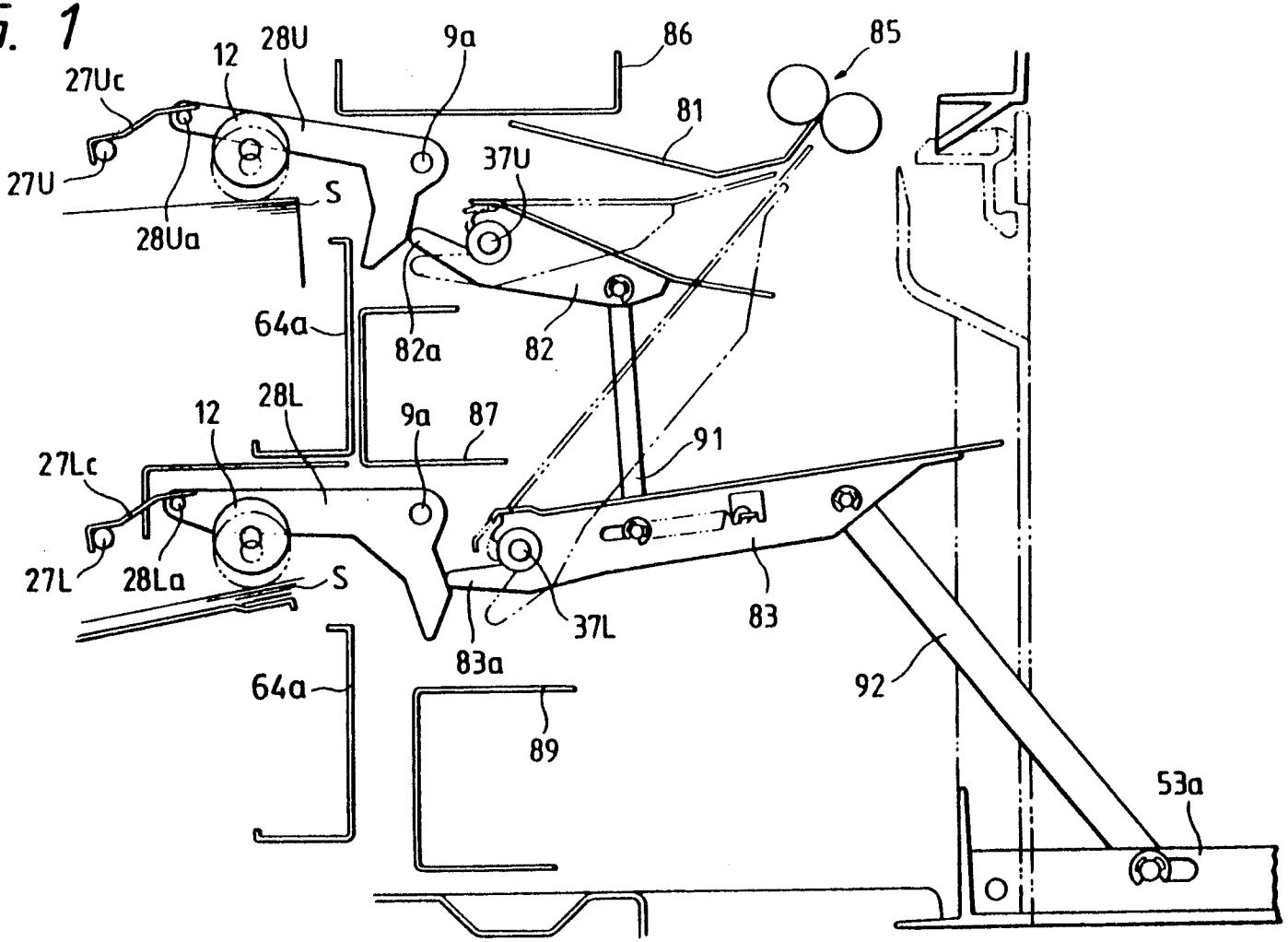
FIG. 1 is a sectional plan view of main portions of an image forming apparatus according to the present invention.
Figure 10:
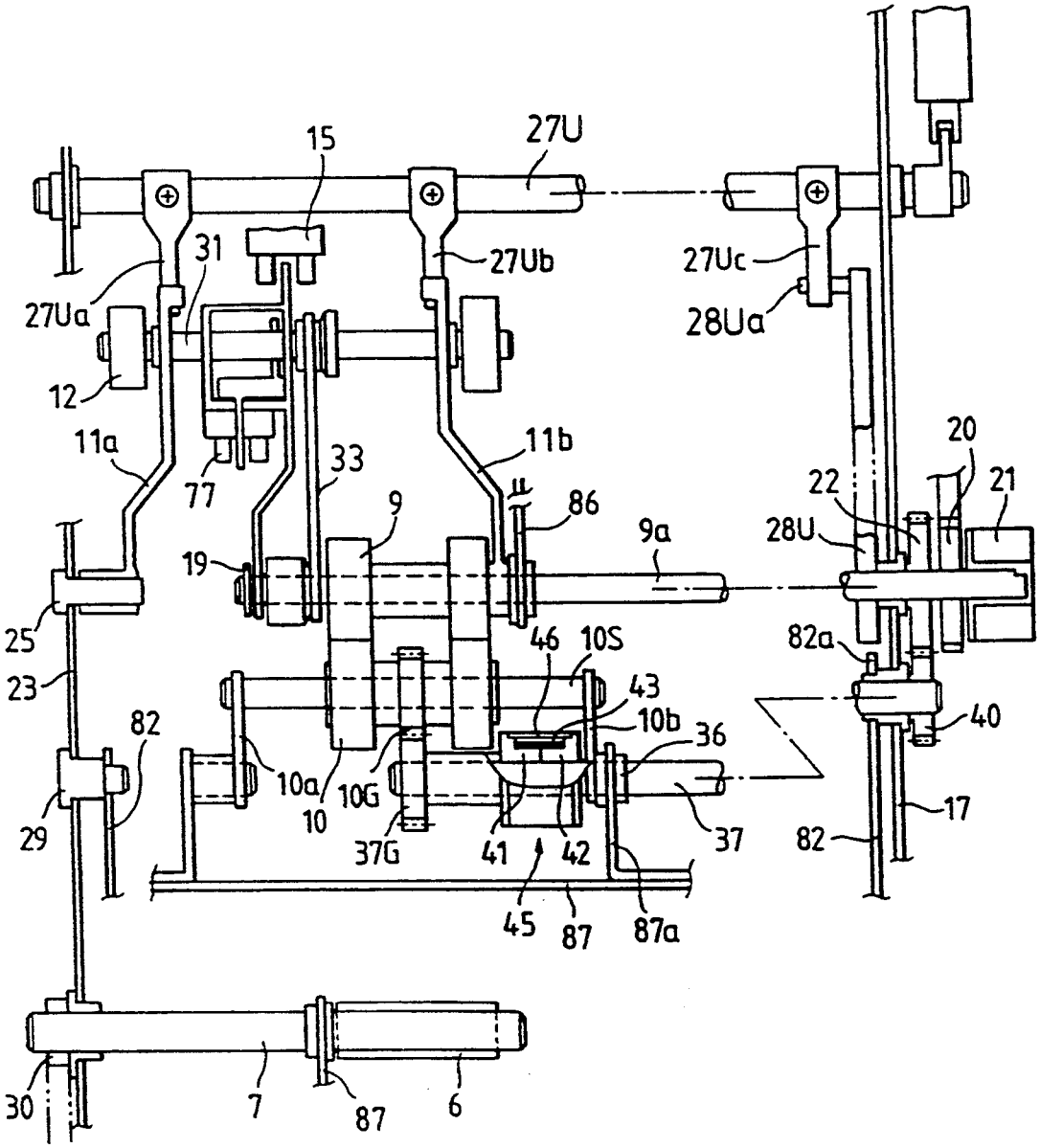

Further, as shown in FIGS. 1 and 2, pick-up release shafts 27U and 27L are supported between the front and rear side plates 23, 17. As shown in FIG. 10, three release plates 27U*a*, 27U*b* and 27U*c* are fixed to the shaft 27U, and, similarly, release plates 27L*a*, 27L*b* and 27L*c* are fixed to the shaft 27L. Further, the release plate 27U*c* is adapted to engage by a pin 28U*a* of a release arm 28U rotatably supported by a shaft 9*a* of the corresponding feeding roller 9, as will be described later, whereas the release plate, 27L*c* is adapted to engage by a pin 28L*a* of a release arm 28L rotatably supported by a shaft 9*a* of the corresponding feeding roller 9, as will be described later.

Figure 4:
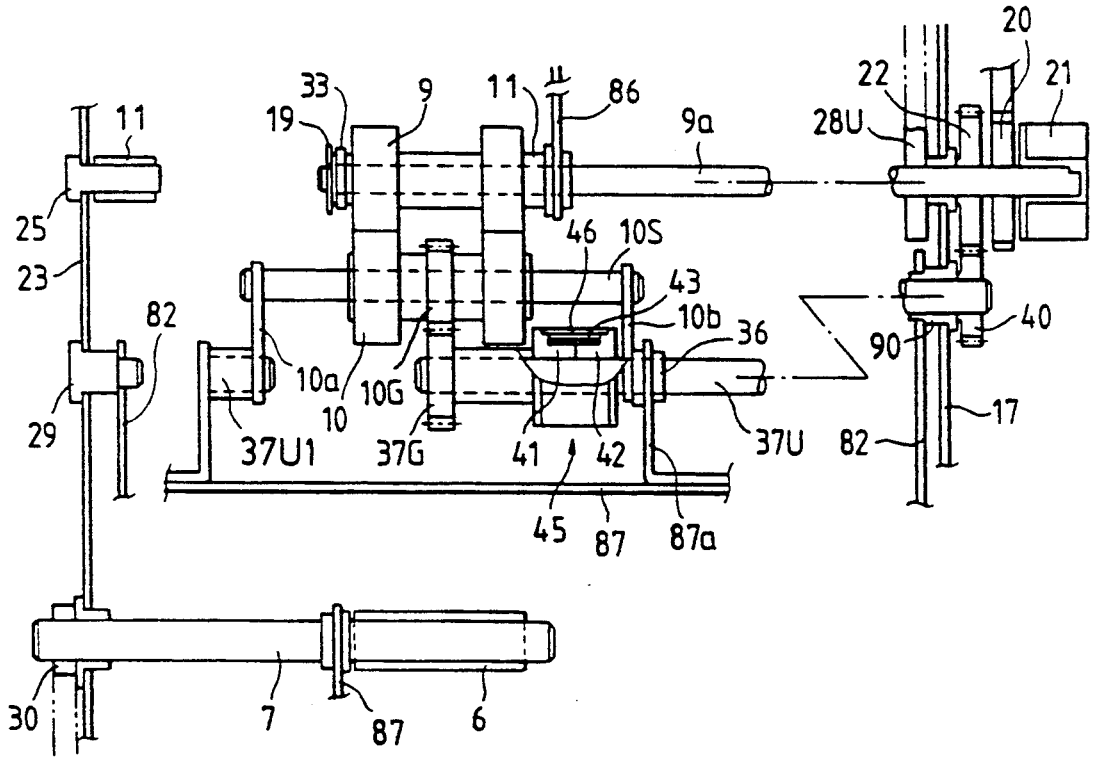

The guide plate 82 is rotatably supported, at its one side, by a bearing 90 attached to the rear side plate 17 and rotatably receiving a shaft 37U, and is also rotatably supported, at its other side, by a pin 29 attached to the front side plate 23 (see FIG. 4). Similarly, the guide plate 83 is rotatably supported, at its one side, by a bearing 90 attached to the rear side plate 17 and rotatably receiving a shaft 37L, and is also rotatably supported, at its other side, by a pin 29 attached to the front side plate 23.

The guide plates 82 and 83 are interconnected by a link arm 91, and the guide plate 83 is in turn connected to a cover 53*a* for opening a portion of the frame body 53, through a link arm 92. A projection 82*a* is formed on a base end of the guide plate 82, which projection is engaged by one end of the release arm 28U, whereas a projection 83*a* is formed on a base end of the guide plate 83, which projection is engaged by one end of a release arm 28L.

The roller shafts 9*a* are rotatably supported by the upper stay 86 and by the rear side plate 17, and each roller shaft 9*a* has the corresponding feeding roller 9 fixed thereto. Further, A pulley 19 is fixed to a free or front end of the roller shaft 9*a* and a support plate 11 is rotatably supported on the roller shaft 9*a* at a rear side with respect to the roller 9. Further, on a rear end of the roller shaft 9*a*, an input gear 20 connected to a drive means (not shown) is idly and rotatably supported, which input gear is designed to be selectively coupled to or discoupled from the roller shaft 9*a* by means of a clutch 21 supported by the roller shaft 9*a*. In addition, a drive gear 22 is fixed to the roller shaft 9*a* in the proximity of the input gear 20.

A pin 25 is fixed to the front side plate 23 in alignment with an axis of the roller shaft 9*a*, and the support plate 11 is rotatably supported by the pin 25. Further, the positioning sensors 15 are arranged on the frame body 53 in the vicinity of free ends of the corresponding support plate 11 in such a manner that the free end of each support plate 11 is situated between a light emitting portion and a light receiving portion of each positioning sensor 15.

Shafts 7 are rotatably supported by the front side plate 23 and by the intermediate stay 87. A gear 30 connected to a motor (not shown) is fixed to a front end of each shaft 7, and the corresponding pressure plate 6 is fixed to a rear end of the respective shaft 7. Further, each support plate 11 rotatably supports a shaft 31 on both ends of which the sheet feed rollers 12 are fixed. In addition, a pulley (not shown) is fixedly mounted on the central portion of the shaft 31, and this pulley is connected to the pulley 19 through the medium of a timing belt 33.

A support plate 87*a* is uprightly formed on the intermediate stay 87, and the aforementioned shaft 37U is rotatably supported by the support plate 87*a* and the rear side plate 17. A gear 40 is fixed to a rear end of the shaft 37U, which gear 40 is meshed with the drive gear 22. On a front end of the shafts 37U1 and 37U, respectively, arms 10*a* and 10*b* for supporting shafts 10S on which the separating rollers 10 are fixed are pivotally supported. An output drum 41 is freely and rotatably supported on the shaft 37 in the proximity of the arm 10*b*, and an input drum 42 is fixed to the shaft 37 in the vicinity of the output drum 41. A clutch spring 43 wound in a clockwise direction looked at from a front side is wound around the input drum 42 and the output drum 41, thereby constituting a clutch 45 acting as a torque limiter during anticlockwise rotation. Incidentally, the reference numeral 46 designates a clutch case for protecting the clutch spring 43. Further, a gear 37G rotated together with the output drum 41 is arranged on the end of the shaft 37U, which gear 37G is meshed with a gear 10G fixed to the shaft 10S of the separating roller 10.

According to the illustrated embodiment, with the above-mentioned arrangement, when the cassettes 65U and 65L are inserted into the frame body 53 along the guide rails 64*a*, the cassettes 65U, 65L are detected by cassette sensors (not shown), which emit detection signals. When a detection signal is received, a controller (not shown) judges whether the free ends of the support plates 11 are detected by the respective positioning sensors 15, i.e., whether the sheet feed rollers 12 are positioned in their sheet feeding positions, on the basis of the signals from such positioning sensors 15. If it is judged that the sheet feed rollers 12 are positioned in their sheet feeding positions, the copying machine is waiting until a start key (not shown) is depressed.

On the other hand, when the sheet feed rollers 12 are not positioned in their sheet feeding positions, i.e., when the positioning sensors 15 do not detect the respective free ends of the support plates 11, the controller causes a motor (not shown) to rotate the gears 30 in a clockwise direction. Consequently, the shafts 7 are rotated in a clockwise direction, thus turning the pressure plates 6 in a clockwise direction to lift the respective intermediate plates 5, with the result that the sheet feed rollers 12 and the support plates 11 are lifted by the intermediate plates 5 through the sheet S. And, when the positioning sensors 15 detects the respective free ends of the support plates 11, the signals are transmitted from the positioning sensors 15 to the controller, and then the controller judges that the sheet feed rollers 12 are positioned in their sheet feeding positions, thus stopping the motor.

Thereafter, when an operator depresses the start key with designating of the supply of the sheet from the upper cassette, the input gear 20 rotated by a motor (not shown) is coupled to the upper roller shaft 9*a*, thus rotating this roller shaft 9*a* in an anticlockwise direction. Consequently, the feeding roller 9 and the pulley 19 are also rotated, and the rotation of the pulley 19 is transmitted to the shaft 31 through the timing belt 33, thus rotating the shaft 31 in an anticlockwise direction. As a result, the upper sheet feed roller 12 is rotated integrally with the shaft 31 to feed the sheets stacked on the intermediated plate 5 of the upper cassette one by one, and the fed sheet is supplied to the associated feeding roller 9.

Figure 6:
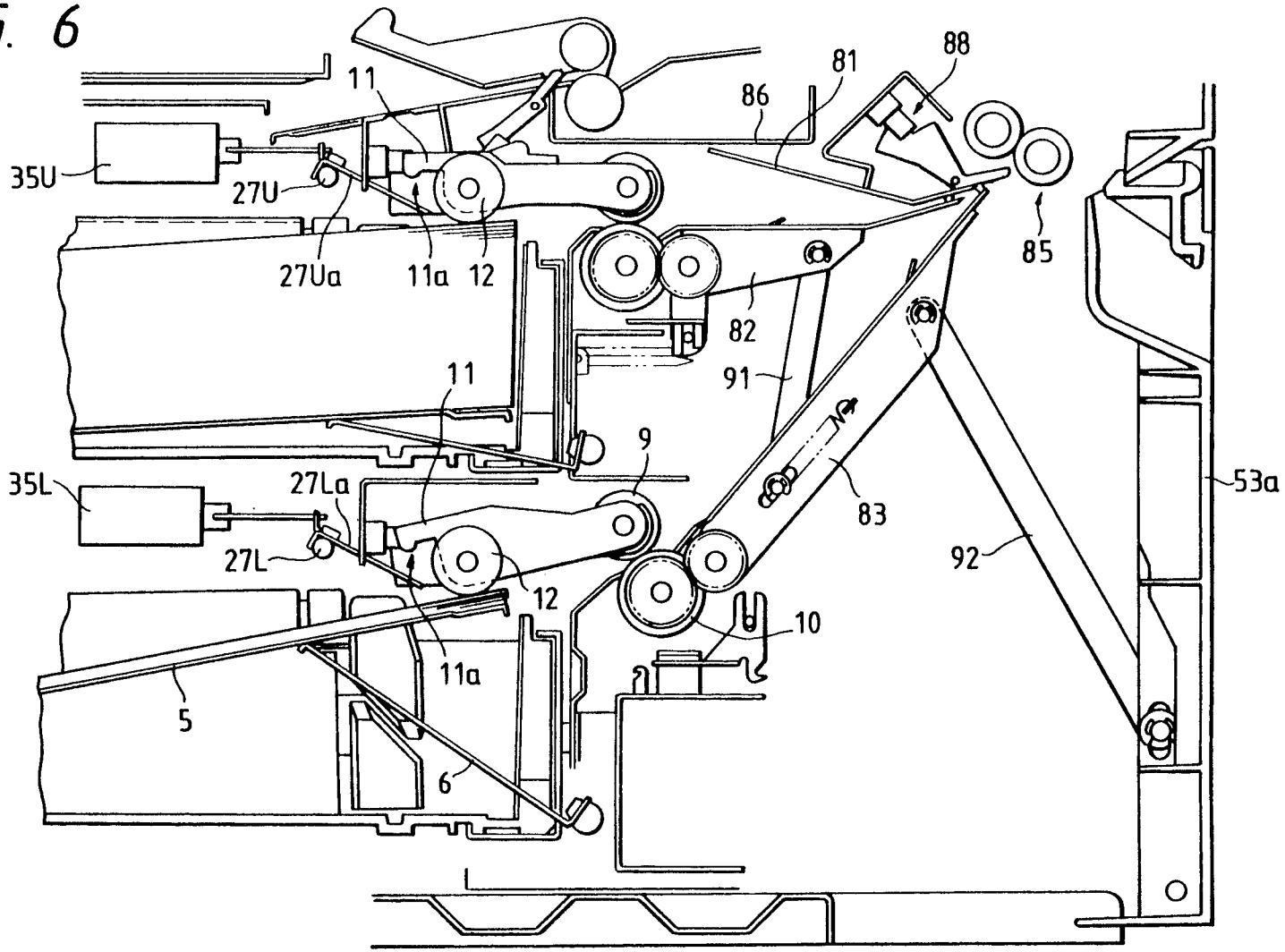

When a predetermined time elapsed after the roller 9 and the separating roller 10, i.e., when a predetermined time period is elapsed after the sheet feed roller 12 starts to rotate, the shaft 27U is rotated in an anticlockwise direction by a solenoid 35U shown in FIG. 6. Consequently, the release plates 27U*a*, 27U*b* lift associated portions 11*a*, 11*b* of the corresponding support plate 11, thus shifting the sheet feed roller 12 upwardly to separate it from the surface of the sheet S. Now, when a single sheet is fed, the separating roller 10 is rotated in response to the movement of the sheet S conveyed by the feeding roller 9. However, if a plurality of sheets S are double fed, the separating roller 10 is rotated in a reverse direction by the action of the torque limiter 45, thus returning the sheets successively from the underside.

Figure 3:
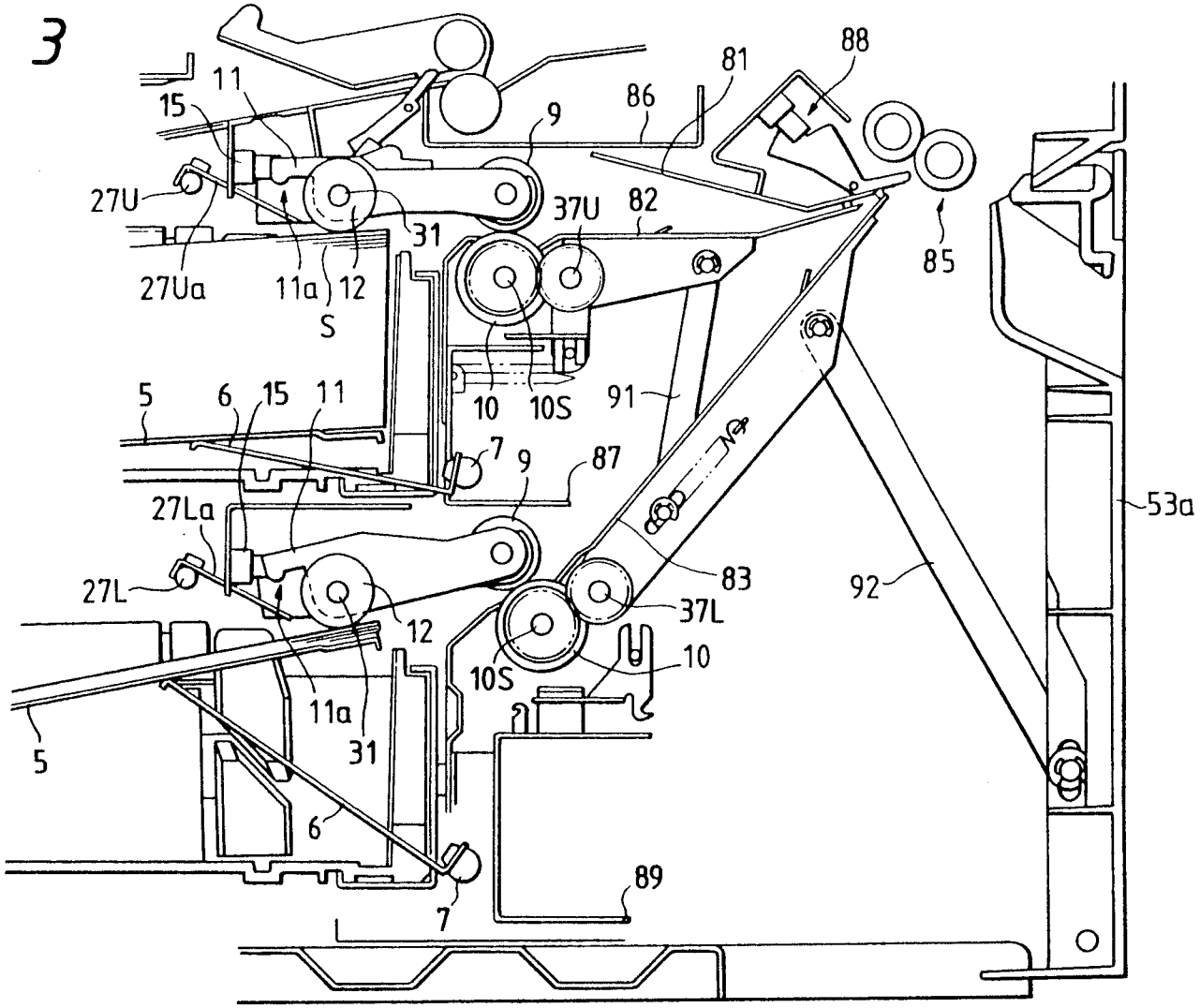
FIGS. 3 and 4 are views showing the details of the apparatus of FIG. 2.

In this way, the sheets S . . . are separated one by one by means of the feeding roller 9 and the separating roller 10. Then the sheet is fed between the guides 81 and 82 and then is guided to the pair of regist rollers 85. As seen in FIGS. 3 and 6, the distance between the feeding and separating rollers 9, 10 and the guides 81, 82 is less than the length of the sheet in the feeding direction. Thereafter, the sheet S is fed from the paired regist rollers 85 to the pair of regist rollers 67, from where the sheet is fed to the copying portion 52 in synchronous with the operation of said copying portion, where an image is copied on the sheet. Then, the sheet is fed, through the feeding belt 69, to the fixing device 70, where the image on the sheet is fixed thereto. Thereafter, the sheet S is guided to the pair of ejector rollers 72 through the flapper 71, and is ejected out of the frame body 53 by means of the ejector rollers 72.

In case of the double face (double-sided) copying operation, the sheet S on one surface of which the image is formed is guided into the sheet recirculating path 73 by means of the flapper 71, and then is re-fed to the pair of regist rollers 67 by means of the pair of sheet recirculating rollers 75. Thereafter, a new image is copied on the opposite surface (plain surface) of the sheet S in the same manner as mentioned above. After the fixing operation, the sheet is ejected out of the frame body 53.

If any sheet is jammed in the copying portion 52 or in the vicinity of the ejector rollers 72 during continuous copying operation, the sheet S to be copied next is being fed by the sheet feeding device 1. Such sheet must be removed from the frame body 53 in accordance with the jam processing procedure. In this case, the operator confirms a position where the sheet is jammed on the basis of information indicated in a display portion 101 shown in FIG. 5, and removes the jammed sheet from the copying portion 52 or the ejector rollers 72 and opens the cover 53*a*.

By opening the cover 53*a*, the guide plate 82 is turned from a position shown by a dot-and-chain line to a position shown by a solid line through the link arm 92, guide plate 83 and link arm 91 (refer to FIG. 1). Consequently, the projection 82*a* of the guide plate 28U, thus turning the release arm 28U in a clockwise direction, whereby the pin 28U*a* turns the release plate 27U*c*. When the release plate 27U*c* is turned, the release plate 27U*a* is abutted against the associated portion 11*a* of the support plate 11 to turn such support plate 11, thus shifting the sheet feed roller 12 from a position shown by a dot-and-chain line to a position shown by a solid line, whereby the sheet feed roller is separated from the upper surface of the stacked sheets S (see FIG. 1).

Then, the operator removes a sheet S being fed by the feeding roller 9 by pulling the sheet toward the sheet feeding direction through an opening obtained by opening the cover 53*a*. In this case, the sheets other than the sheet S being fed are not removed, because, although these sheet are forwarded by only friction force between these sheets and the sheet S being positively fed, these sheets are abutted against the separating roller 10. When the jam processing procedure is completed and the cover 53*a* is closed again, the guide plates 82, 83 return to the positions shown in FIG. 3. Incidentally, the sheet S abutted against the separating roller 10 does not effect a bad influence upon the re-start of the copying operation.

Figure 5:
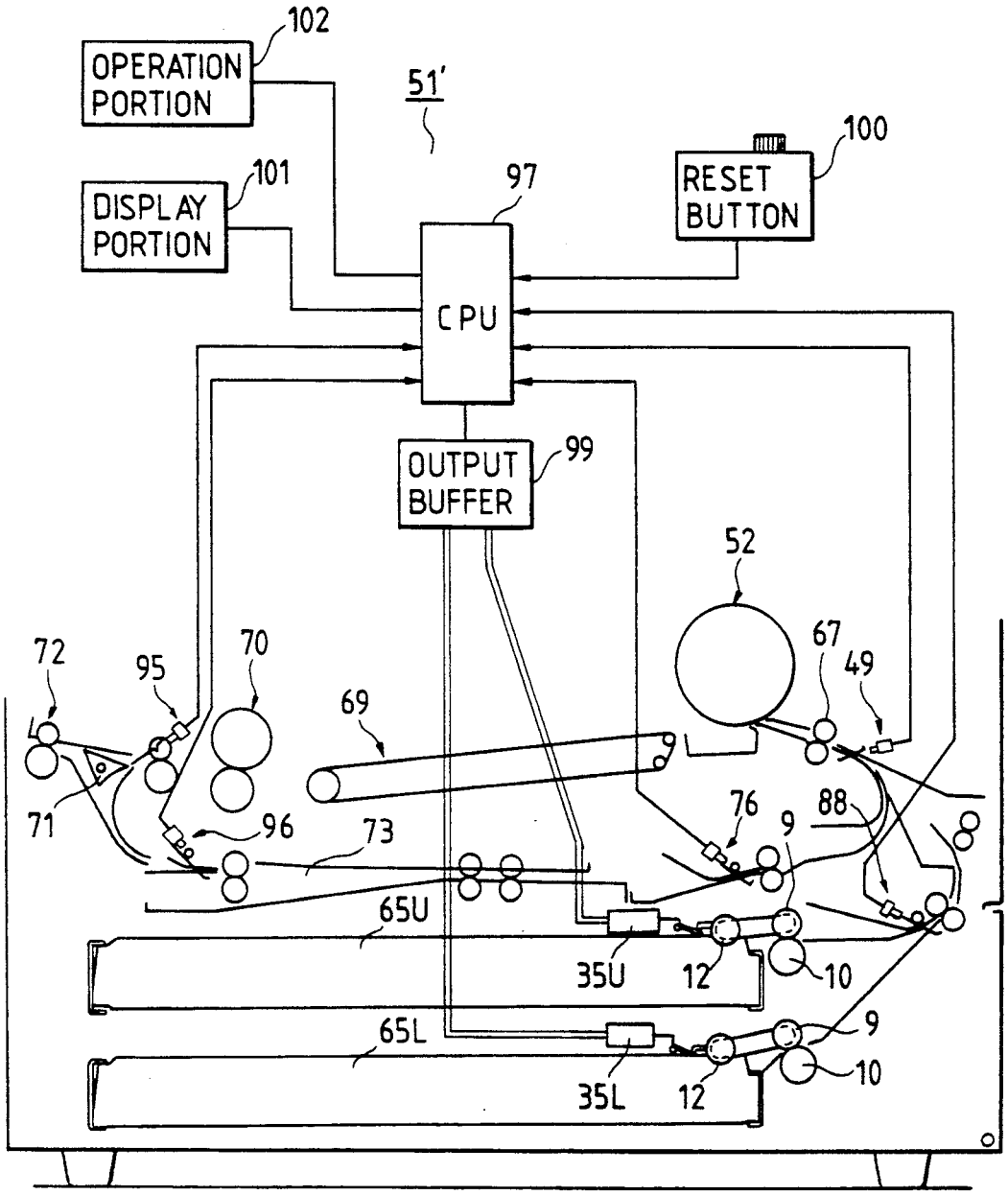
FIGS. 5, 6 and 7 show an image forming apparatus according to another embodiment of the present invention.

Next, another embodiment wherein the feeding rollers 12 are lifted and lowered by means of solenoids will be explained with reference to FIGS. 5 to 7. Incidentally, elements same as those previously mentioned are designated by the same reference numerals as previously used and the explanation thereof will be omitted.

A copying machine 51' includes a CPU 97 which can receive signals from sheet sensors 49, 76, 88, 95 and 96. To the CPU 97, solenoids 35U, 35L are connected through an output buffer 99 and a reset button 100 is also connected. The solenoids 35U, 35L are connected to the release shafts 27U and 27L, respectively, so that, when the solenoids 35U, 35L are turned ON, the shafts 27U, 27L are rotated in anticlockwise directions, respectively.

Figure 7:
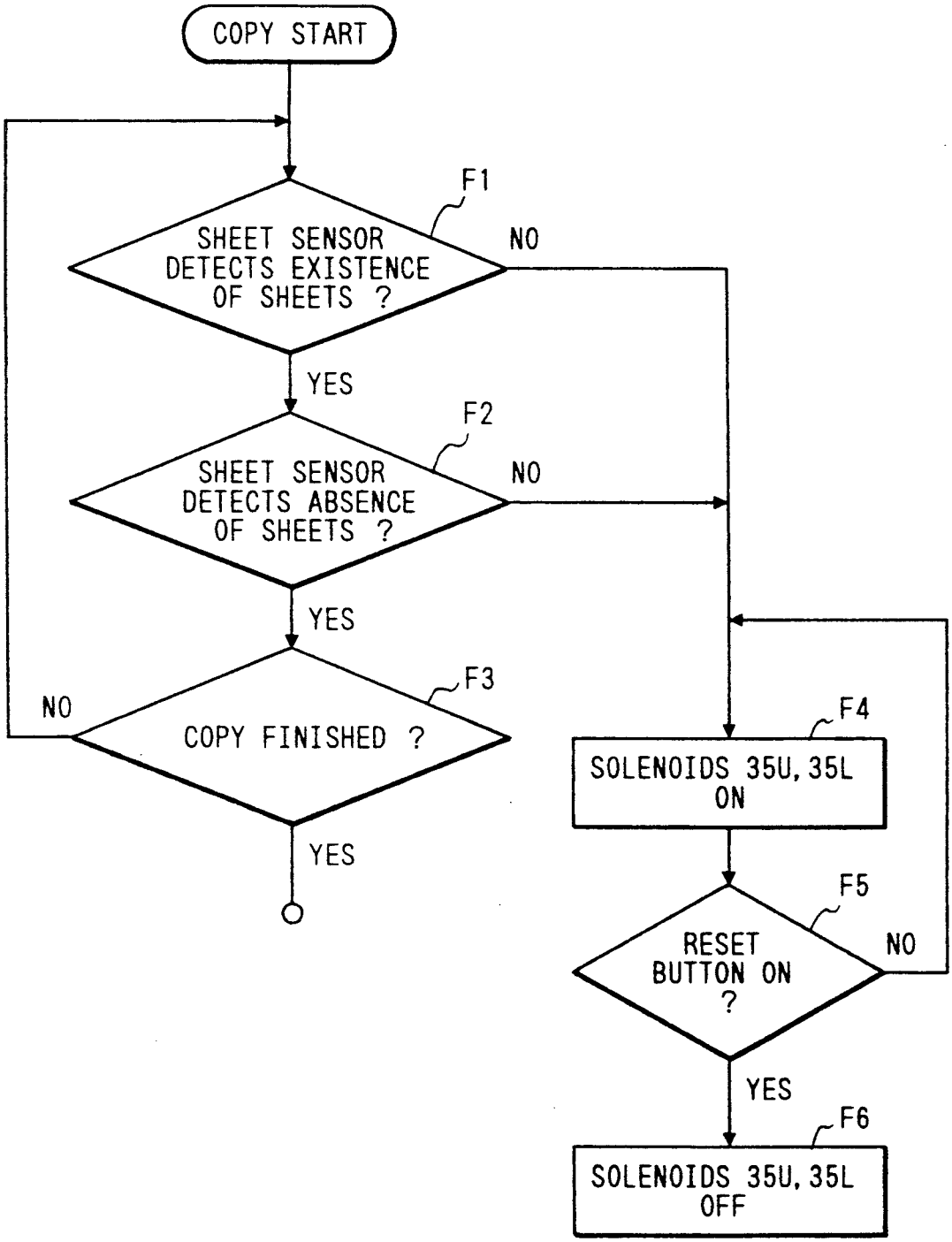
Figure 8A:
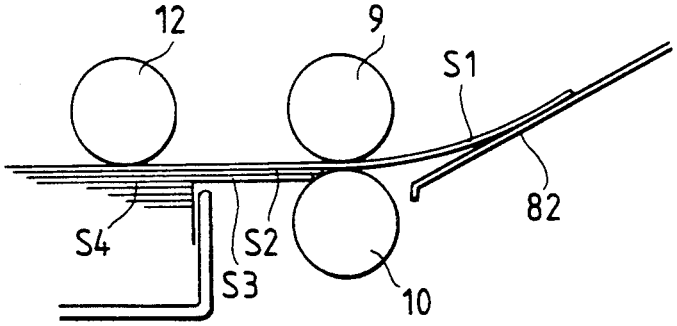
FIGS. 8A, 8B, 8C and 8D are sectional plan views showing a conventional apparatus.
Figure 8B:
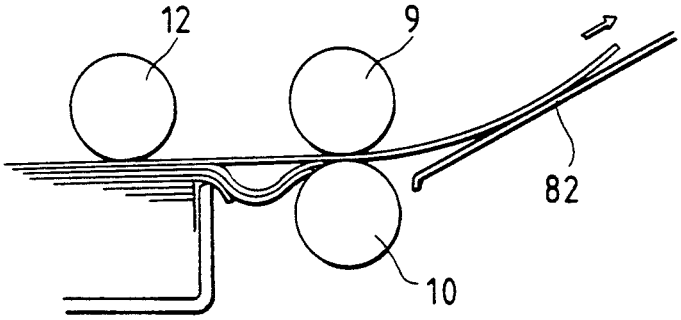
Figure 8C:
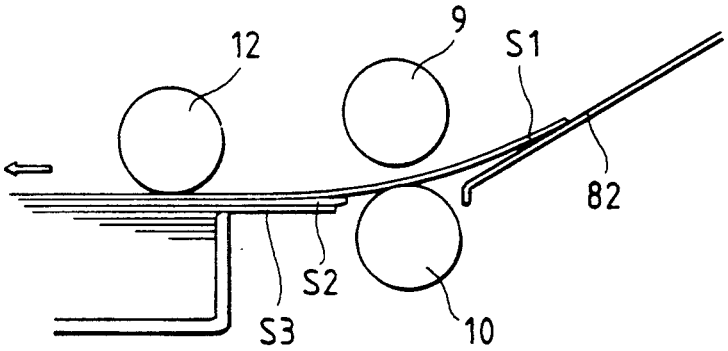
Figure 8D:
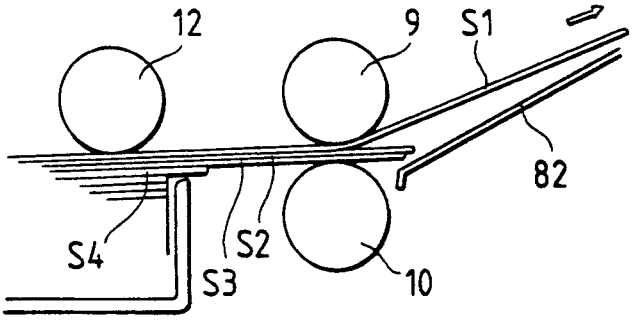

During the copying operation, in the sequence shown in FIG. 7, the CPU 97 judges whether the sheet sensor with which the sheets are associated detects the presence of the sheets (Fl), and if yes (i.e., the CPU judges that the sheet sensor detects the presence of the sheets), the CPU further judges whether the sheet sensor with which the sheets are not associated detects the absence of the sheet (F2). When the CPU judges that the sheet sensor detects the absence of the sheet, the copying operation is started. Then, the CPU 97 judges whether the copying operation regarding a predetermined number of sheets is finished (F3). If the copying operation has not yet been finished, the above processes F1–F3 are repeated until the whole copying operation is completed.

On the other hand, if the sheet sensor does not detect the presence of the sheets in the above process F1 or if the sheet sensor does not detect the absence of the sheet in the above process F2, the CPU 97 stops the copying operation and causes a display portion 101 to indicate the occurrence of the jamming condition Further, the CPU turns the solenoids 35U, 35L ON to rotate the release shafts 27U, 27L in an anticlockwise direction (F4). By the rotation of the shafts 27U, 27L, the release plates 27U*a* and 27L*a* are abutted against the associated portions 11*a* of the support plates 11 to rotate the support plates 11 in a clockwise direction, thus separating the sheet feed rollers 12 from the sheets.

Thereafter, the operator removes the jammed sheet S in the same manner as mentioned above, and then turns the reset button ON to restore the copying machine 51' to the copying condition. Consequently, the solenoids 35U, 35L are turned OFF, and the sheet feed rollers 12 are lowered to contact the sheets again (F5).

Next, the jam detection will further be explained with more detail.

The CPU 97 judges the fact that the jamming condition occurs, when the sheet does not pass through a predetermined zone in the sheet feeding path at a predetermined time. For example, if the sheet sensor 88 does not detect a leading edge of the sheet when a predetermined time period $T_1a$ is elapsed after the sheet feed roller 12 starts to rotate (if the sheet does not reach the sensor 88), and if the sheet sensor 88 is still detecting the sheet after a predetermined time period $T_1b$ longer than the time $T_1a$ has been elapsed (if a trailing edge of the sheet has not yet been passed through the sensor 88), the CPU judges that the jamming condition occurs, and emits a jam signal.

Similarly, predetermined times $T_2a$, $T_2b$; $T_3a$, $T_3b$; $T_4a$, $T_4b$; $T_5a$, $T_5b$ are set for each of the sheet sensors 49, 95, 96, 76, the occurrence of the jamming condition is judged with reference to these predetermined times. Incidentally, as to each of the sheet sensors 95 and 96, it is preferable to use a time after the regist rollers 67 feed out the sheet, as the predetermined time.

I claim:

1. A sheet feeding apparatus comprising:

sheet containing means for accommodating stacked sheets, with the sheets having a predetermined length in their conveying direction;

sheet feeding means for feeding a sheet in a sheet feeding direction by contacting the stacked sheets in said sheet containing means;

guide means for guiding the sheet fed by said sheet feeding means, said guide means being shiftable to open a sheet feeding path, a distance between an upstream side end of said guide means with respect to the sheet feeding direction and said sheet feeding means being shorter than the length of the sheet in its conveying direction; and spacing means for separating said sheet feeding means from the stacked sheets in response to the shifting of said guide means.

2. A sheet feeding apparatus according to claim 1, wherein said sheet feeding means is movable in a direction substantially perpendicular to a sheet feeding direction.

3. A sheet feeding apparatus according to claim 1, wherein said sheet feeding means includes a roller having a sheet feeding surface for providing a sheet feeding force by contacting the sheet along its entire surface.

4. A sheet feeding apparatus according to claim 1, wherein said guide means includes a guide member rotatably supported for guiding the sheet.

5. A sheet feeding apparatus according to claim 1, further including a support means for shiftably supporting said sheet feeding means.

6. A sheet feeding apparatus according to claim 5, wherein said support means includes a supporting member which supports said sheet feeding means at its end and is rockably supported.

7. A sheet feeding apparatus according to claim 6, wherein said guide means includes a guide member rotatably supported for guiding the sheet.

8. A sheet feeding apparatus according to claim 7, wherein said guide means has an engagement portion engageable with said supporting member to shift the latter when said guide member is rotated.

9. A sheet feeding apparatus according to claim 1, further including a sheet separating means for separating the sheets fed by said sheet feeding means.

10. A sheet feeding apparatus according to claim 9, wherein said sheet separating means includes a separating member for contacting the sheet and for separating the sheets by a friction force.

11. A sheet feeding apparatus according to claim 9, wherein said sheet separating means includes a first rotary member for feeding the sheet in the same direction as said sheet feeding direction to which the sheet is fed by said sheet feeding means, and a second rotary member for pinching and feeding the sheet in cooperation with said first rotary member and feeding the sheet in a direction opposite to said sheet feeding direction when a plurality of sheets are pinched.

12. A sheet feeding apparatus according to claim 1, wherein said sheet containing means is shiftable in the direction orthogonal to the sheet feeding direction.

13. A sheet feeding apparatus comprising:

sheet containing means for accommodating stacked sheets, with the sheets having a predetermined length in their conveying direction;

sheet feeding means for feeding a sheet in a sheet feeding direction by contacting the stacked sheets in said sheet containing means;

sheet feeding path for passing the sheet fed by said sheet feeding means therethrough;

guide means provided shiftably to open said sheet feeding path by shifting thereof, a distance between an upstream side end of said guide means with respect to the sheet feeding direction and said sheet feeding means being shorter than a sheet length in its conveying direction;

jam detecting means for detecting a jam condition in said sheet feeding path; and spacing means for separating said sheet feeding means from the stacked sheets in response to the detection of the jam condition by said jam detecting means.

14. A sheet feeding apparatus according to claim 13, wherein said sheet feeding means is movable in a direction transverse to the sheet.

15. A sheet feeding apparatus according to claim 13, wherein said sheet feeding means includes a roller which can contact the sheet with its periphery.

16. A sheet feeding apparatus according to claim 13, wherein said sheet feeding path includes a guide member for guiding the sheet, said guide member being shiftable to open said sheet feeding path.

17. A sheet feeding apparatus according to claim 13, wherein said jam detecting means emits a jam signal when the sheet does not pass through a predetermined zone in said sheet feeding path within a predetermined time period.

18. A sheet feeding apparatus according to claim 13, further including a support means for shiftably supporting said sheet feeding means.

19. A sheet feeding apparatus according to claim 18, wherein said support means includes a supporting member which supports said sheet feeding means at its end and is rockably supported.

20. A sheet feeding apparatus according to claim 13, wherein said spacing means includes an actuator for shifting said sheet feeding means in response to the detection of the jamming condition by means of said jam detecting means.

21. An image forming apparatus comprising:

containing means adapted for accommodating stacked sheets and shiftable from a predetermined position of a body of the image forming apparatus;

feeding means for feeding a sheet in a sheet feeding direction by contacting the stacked sheets in said containing means;

image forming means for forming an image on the sheet fed by said feeding means;

guide means for guiding the sheet along a feeding path from said feeding means to said image forming means:

a cover provided on the body of the image forming apparatus and movable to open said feeding path, a distance between an upstream side end of said guide means with respect to the sheet feeding direction and said feeding means being shorter than a sheet length in its conveying direction; and spacing means for separating said feeding means from the stacked sheets in response to the movement of said cover.

22. An image forming apparatus according to claim 21, wherein said containing means is shiftable in a direction perpendicular to a sheet feeding direction to which the sheet is fed by said feeding means.

23. An image forming apparatus according to claim 21, wherein said feeding path includes a guide member for guiding the sheet, said guide member being shiftable to open said feeding path.

24. An image forming apparatus according to claim 21, said guide member shifts in response to movement of said cover.

25. An image forming apparatus, comprising:

sheet accommodating means for accommodating stacked sheets therein, with the sheets having a predetermined length in their conveying direction;

sheet feeding means for feeding a sheet in a sheet feeding direction by contacting the stacked sheets in said accommodating means;

guide means for guiding the sheet fed by said sheet feeding means, said guide means being shiftable to open a sheet feeding path, with a distance between an upstream side end of said guide means with respect to the sheet feeding direction and said feeding means being shorter than a length of the sheet in its conveying direction;

spacing means for spacing said sheet feeding means from the stacked sheet in response to the shifting of said guide means; and image forming means for forming images on the sheet guided by said guide means.

26. A image forming apparatus according to claim 24, wherein said sheet accommodating means is shiftable between a first position capable of feeding the sheet and a second position incapable of feeding the sheet, and further having means for causing the sheet accommodated in said sheet accommodating means to contact said sheet feeding means after causing said sheet accommodating means to shift from a non-feeding position to a feeding position.

27. A sheet feeding apparatus, comprising:

sheet stacking means for stacking sheets therein;

sheet feeding means for feeding the sheets in a sheet feeding direction by contacting the sheets stacked in said sheet stack means;

a sheet feeding path, disposed along a side wall openable to a main body of said sheet feeding apparatus, for introducing the sheet fed out by said sheet feeding means, said sheet feeding path having a guide shiftable to open the sheet feeding path, with said guide being opened in response to opening said side wall, and a distance between an upstream end of said guide and said sheet feeding means being shorter than a length of the sheet in the feeding direction; and spacing means for spacing said sheet feeding means from said sheet stacking means in response to shifting of said guide.

28. A sheet feeding apparatus according to claim 27, wherein said sheet feeding means has a rotary member which gives a feeding force to the sheet by rotating while contacting the sheet.

29. A sheet feeding apparatus according to claim 27, wherein said spacing means has a link mechanism for shifting said guide to said sheet feeding means for spacing said sheet feeding means from the sheet.

30. A sheet feeding apparatus according to claim 27, further having support means for rotatably supporting said guide.

31. A sheet feeding apparatus according to claim 27, further comprising separating means disposed between said guide and said sheet feeding means for allowing only one sheet at a time to pass from the stack of sheets.

32. A sheet feeding apparatus according to claim 31, wherein said separating means has a first rotary member rotating in a first direction to feed the sheet in the sheet feeding direction, and a second rotary member rotating in a second direction opposite to the first direction and contacting the sheet in cooperation with said first rotary member.

33. A sheet feeding apparatus, comprising:

sheet stacking means for stacking sheets therein;

sheet feeding means for feeding the sheets in a sheet feeding direction by contacting the sheets stacked in said sheet stack means;

image forming means for forming an image on the sheets;

a sheet path, disposed along a side wall openable to a main body of said sheet feeding apparatus, for introducing the sheet fed from said sheet feeding means to said image forming means, said sheet feeding path having a guide shiftable to open the sheet path, with said guide being opened in response to opening said side wall, and a distance between an upstream end of said guide and said sheet feeding means being shorter than a length of the sheet in the sheet feeding direction; and spacing means for spacing said sheet feeding means from the sheet stacked in said sheet stacking means in response to shifting of said guide.

34. A sheet feeding apparatus, comprising:

sheet containing means for accommodating stacked sheets therein, with the sheets having a predetermined length in their conveying direction;

sheet feeding means for feeding sheets in a sheet feeding direction by contacting the stacked sheets in said sheet containing means;

guide means for guiding the sheet fed by said sheet feeding means, said guide means being shiftable to open a sheet feeding path; and spacing means for separating said sheet feeding means from the stacked sheets in response to the shifting of said guide means.

* * * * *

UNITED STATES PATENT AND TRADEMARK OFFICE

CERTIFICATE OF CORRECTION

PATENT NO. : 5,122,841 Page 1 of 3

DATED : June 16, 1992

INVENTOR(S) : Nobukazu Sasaki

It is certified that error appears in the above-identified patent and that said Letters Patent is hereby corrected as shown below:

COLUMN 1:

Line 65, "(S)" should be deleted.

COLUMN 2:

Line 30, change "drawings" to --drawings.--.
Line 65, "and 64b" should be deleted.
Line 68, change "guide rails 64b." to --guide rails 64a.--.

COLUMN 3:

Line 1, change "64b" to --64a--.
Line 5, change "associated" to --association--.
Line 12, "10 " should be deleted.
Line 24, change "release plate, 27Lc" to --release plate 27Lc--.
Line 50, change "A" to --a--.

COLUMN 4:

Line 61, change "detects" to --detect--.

UNITED STATES PATENT AND TRADEMARK OFFICE

CERTIFICATE OF CORRECTION

PATENT NO. : 5,122,841

DATED : June 16, 1992

INVENTOR(S) : Yamamoto et al.

It is certified that error appears in the above-identified patent and that said Letters Patent is hereby corrected as shown below:

COLUMN 5:

Line 13, change "roller 9" to --the fed sheet has reached a nip between the feeding roller 9--.

COLUMN 6:

Line 2, change "plate 28U," to --plate 82 is abutted against the one end of the release arm 28U,--.

Line 61, change "condition" to --condition.--.

COLUMN 7:

Line 55, change "entire surface" to --entire conveying direction--.

COLUMN 9:

Line 55, change "claim 24," to --claim 25,--.

UNITED STATES PATENT AND TRADEMARK OFFICE

CERTIFICATE OF CORRECTION

PATENT NO. : 5,122,841

DATED : June 16, 1992

INVENTOR(S) : Yamamoto, et al

It is certified that error appears in the above-indentified patent and that said Letters Patent is hereby corrected as shown below:

COLUMN 10:

Line 53, change "the sheet" to --the sheets--.

Signed and Sealed this

Twenty-sixth Day of October, 1993

*Attest:*

*Attesting Officer*

BRUCE LEHMAN

*Commissioner of Patents and Trademarks*